United States Patent [19]

Hansen

[11] Patent Number: 5,017,086

[45] Date of Patent: May 21, 1991

[54] HYDRAULIC PERIPHERY PUMPS

[75] Inventor: Lowell D. Hansen, Jackson, Miss.

[73] Assignee: Vickers Incorporated, Troy, Mich.

[21] Appl. No.: 349,324

[22] Filed: May 8, 1989

[51] Int. Cl.[5] ..... F04D 5/00

[52] U.S. Cl. ..... 415/55.5; 415/143

[58] Field of Search ..... 415/143, 55.1, 55.5, 415/55.6, 55.7, 199.6, 199.2; 417/68, 69

[56] References Cited

U.S. PATENT DOCUMENTS

| | | | |
|---|---|---|---|
| 2,247,335 | 6/1941 | Neibert | 415/55.1 X |
| 2,461,865 | 2/1949 | Adams | 417/69 |
| 2,581,828 | 1/1952 | Adams | 417/69 |
| 2,952,214 | 9/1960 | Adams | 417/69 |
| 4,556,363 | 12/1985 | Watanabe et al. | 415/55.6 X |

FOREIGN PATENT DOCUMENTS

| | | | |
|---|---|---|---|
| 3303460 | 8/1984 | Fed. Rep. of Germany | 415/55.6 |

OTHER PUBLICATIONS

Performance of the Rotray Pump by H. W. Iverson, Berkelt, Calif. Jan. 1955.

*Primary Examiner*—John T. Kwon

*Attorney, Agent, or Firm*—Barnes, Kisselle, Raisch, Choate, Whittemore & Hulbert

[57] ABSTRACT

A hydraulic periphery pump that includes a housing having a pump drive shaft mounted for rotation about its axis. An impeller is coupled to the drive shaft for rotation within the housing and has a disc-shaped body with axially orientated substantially flat side faces. A circumferential array of vanes are formed around the periphery of the impeller body. Backup plates in the housing have flat faces opposed to the impeller side faces. An arcuate fluid chamber surrounds the impeller periphery and has angularly spaced fluid inlet and outlet ports. Axially orientated slots or channels in the impeller side faces cooperate with fluid passages in the backup plates to centrifugally boost fluid pressure and, in effect, form a liquid-piston boost first stage for the periphery pump chamber, or to form a two-stage impeller system.

18 Claims, 8 Drawing Sheets

HYDRAULIC PERIPHERY PUMPS

The present invention is directed to rotary hydraulic pumps, and more particularly to a periphery pump that is particularly well adapted for use as a boost pump in an aircraft turbine engine fuel delivery system.

BACKGROUND AND OBJECTS OF THE INVENTION

Hydraulic periphery pumps conventionally include a housing having a drive shaft mounted for rotation about its axis. An impeller is coupled to the drive shaft for rotation within the housing, and has a disc-shaped body with axially opposed substantially flat side faces and a circumferential array of peripheral vanes. A pair of backup bearing plates are mounted within the housing and have flat inner faces slidably opposed to the flat side faces of the impeller. An arcuate fluid chamber is formed between the backup plates and the housing around the periphery of the impeller, and has angularly spaced fluid inlet and outlet ports. A periphery pump of this character, also called a tangential, turbine-vane, regenerative, turbulence or friction pump, produces pumping action by motion of the vaned periphery in the arcuate chamber containing the fluid. Fluid within the chamber is propelled by friction with the impeller vanes and, with suitable restraints in the chamber, the fluid head is increased in the direction of fluid flow. H. W. Iversen, "Performance of the Periphery Pump," Transactions of the ASME, January 1955, pages 19–28, provides a theoretical background discussion of periphery pumps of this character.

Design constraints and specifications for fuel pumps in aircraft turbine engine fuel delivery systems are such that periphery pumps of the subject character conventionally cannot be employed. For example, fuel pressure and flow requirements during low-speed starting typically are such that positive displacement pumps, such as vane-type pumps, must be employed. System designs specifications typically require fuel pumps to operate at a specified flow rate with a vapor/liquid inlet ratio of 0.45, and with a net positive suction pressure or NPSP, which is the pressure at the pump inlet above true vapor pressure of the fuel, of 5 psi. Newer system specifications, however, require the 0.45 vapor/liquid inlet ratio capability over a wider engine flow range, and may even require a 1.0 vapor/liquid ratio with intermittent all-liquid or all-vapor operation. Furthermore, the NPSP requirements have been increased to 5 psi over the entire engine flow range, and in some cases even 3 psi over the engine flow range.

It is therefore a general object of the present invention to provide a rotary hydraulic periphery pump that is capable of satisfying flow requirements in aircraft turbine engine fuel delivery systems over an extended engine operating range, and that is adapted to operate at a vapor/liquid inlet ratio up to 1.0 without cavitation and at 3 psi NPSP over an extended engine fuel flow range. A further object of the present invention is to provide a fuel pump of the describe character that is economical and efficient in construction in terms of the stringent weight and volume requirements in aircraft applications, and that provides reliable service over an extended operating lifetime.

SUMMARY OF THE INVENTION

A hydraulic periphery pump in accordance with the present invention includes a housing having a pump drive shaft mounted for rotation about its axis. An impeller is coupled to the drive shaft for rotation within the housing and has a disc-shaped body with at least one, preferably two, axially orientated substantially flat side faces. A circumferential array of vanes is formed around the periphery of the impeller body. Backup plates in the housing have flat faces opposed to the impeller side faces. An arcuate fluid chamber surrounds the impeller periphery and has angularly spaced fluid inlet and outlet ports. In accordance with a distinguishing feature of the present invention, radially orientated slots or channels in at least one, preferably both, of the impeller side faces cooperate with fluid passages in the backup plates to centrifugally boost fluid pressure and, in effect, form a liquid-piston boost or couple a radial impeller at the periphery pump inlet.

More specifically, the radially orientated slots or channels, which are formed on both side faces of the impeller in the preferred embodiments of the invention, have closed radially inner and outer ends in arrays concentric with the axis of impeller rotation. A counterbore pocket in the backup plates feed inlet fluid to the radially inner ends of the impeller channels during impeller rotation. Second ports in the backup plates receive fluid from the outer ends of the channels when the arcuate portions of the backup plates open to impeller slots during impeller rotation, with fluid pressure having been boosted between the first and second ports by centrifugal force during flow through the impeller channels. The fluid is then fed through passages in the backup plates to channels extending around the back or impeller-remote faces of the backup plates, and thence to the inlet of the fluid chamber around the impeller periphery.

A second implementation of the invention employs the first ports in the backup plates to feed fluid to the radially inner ends of the impeller channels during first arcuate portions of impeller rotation. Second arcuate ports in the backup plates receive fluid from the impeller after passing through the cross section port. The cross section to fluid flow in the backup plate channels is tailored to obtain a liquid-piston boost effect from centrifugal forces imparted on the fluid, and thereby boost fluid pressure to the periphery pump stage. The liquid-piston effect obtains low-pressure inlet performance over a wide flow range, while the periphery impeller stage obtains high output pressure. The invention thus provides desired performance characteristics in an attractive package size and is capable of meeting interstage pressure requirements of most aircraft engine fuel delivery systems.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
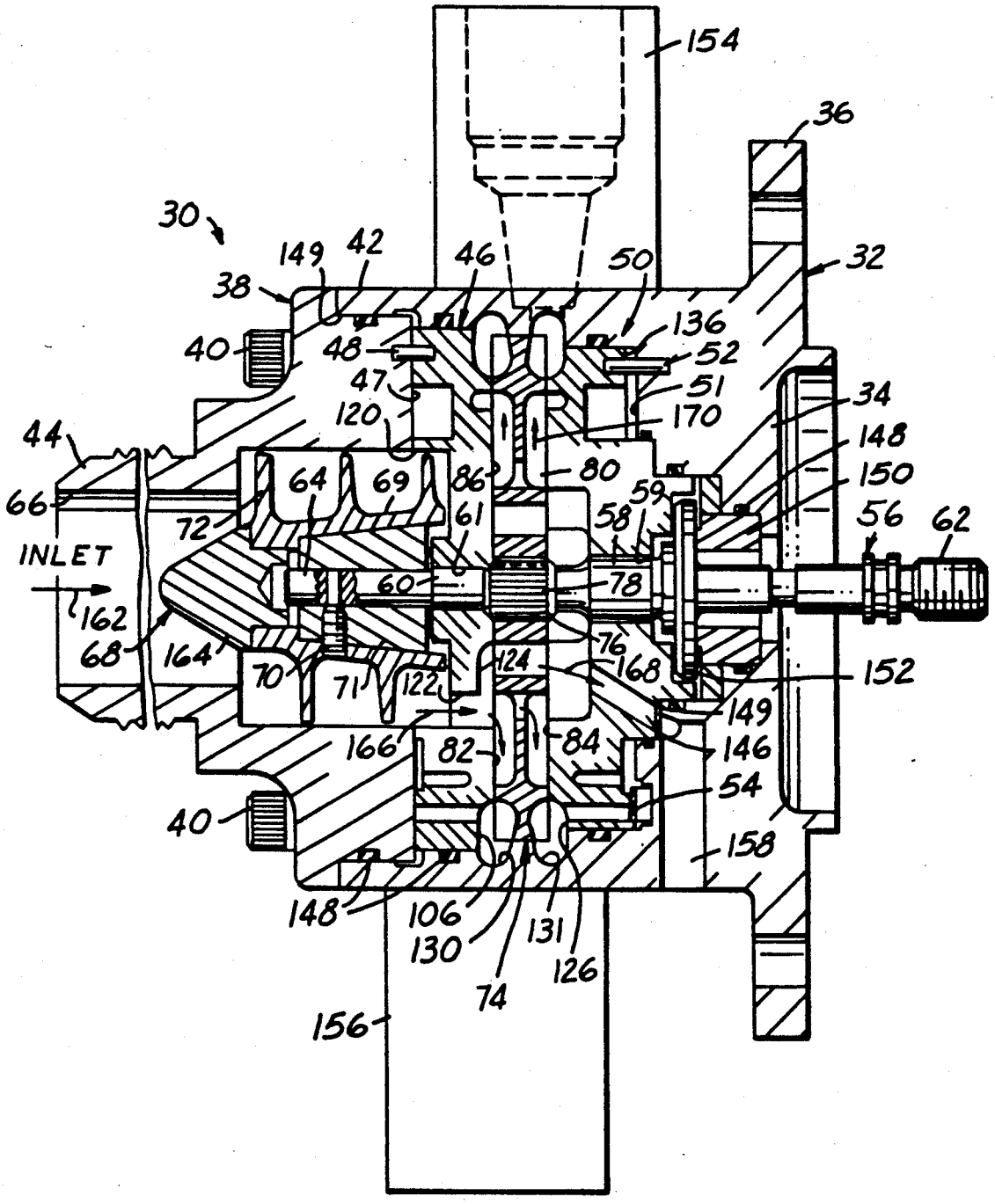
FIG. 1 is a diametrically sectioned side elevational view of a periphery pump in accordance with one presently preferred embodiment of the invention.
Figure 3:
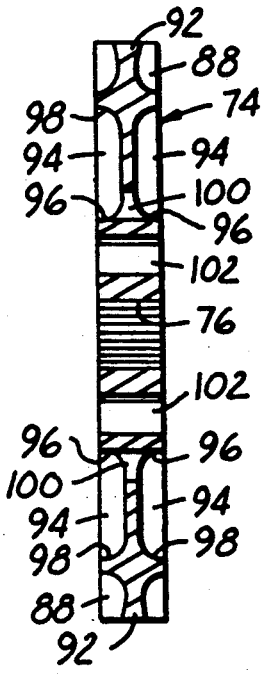
FIG. 3 is a sectional view taken substantially along the line 3—3 in FIG. 2.

FIGS. 1-13 illustrate a periphery pump 30 in accordance with a first embodiment of the invention as comprising a generally cup-shaped housing 32 (FIG. 1) having a base 34 from which a flange 36 radially projects for mounting pump 30 to suitable pump-support structure (not shown). An inlet cover 38 is affixed by the screws 40 to the open edge of housing sidewall 42. An inlet collar 44 projects outwardly from cover 38 coaxially with sidewall 42 for internally receiving inlet fluid. A rear backup plate 46 is mounted within housing sidewall 42, generally coaxially therewith, against an inner face 47 of cover 38, being circumferentially orientated with respect thereto by the locating pins 48. A front backup plate 50 is mounted to the stepped inner face 51 of housing base 34, and is circumferentially orientated by the locating pins 52 to align to housing 32 and backup plate 46. Backup plate 50 is resiliently urged toward backup plate 46 by a spring 54 captured between the outer face 136 of backup plate 50 and the opposing inner face 51 of housing base 34.

A pump drive shaft 56 has lands 58, 60 rotatably journalled within corresponding openings 59, 61 in backup plates 50, 46 respectively. One end 62 of drive shaft 56 extends axially outwardly from housing base 34 for connection to a source of motive power (not shown). The opposing end 64 of drive shaft 56 extends into the central inlet passage 66 of collar 44 and cover 38 coaxially with sidewall 42. An inducer 68 comprises a conical skirt 69 received over a wedge 71 and affixed by a setscrew 70 to shaft end 64. Spiral vanes 72 project radially from skirt 69 to closely adjacent the surrounding surface of passage 120. A conical diverter nose 164 is press fitted into the narrow open end of skirt 69. The peripheries of backup plates 46, 50 and inlet cover 38 are sealed by suitable packings 148 against the surrounding inwardly directed stepped surface 149 of shell sidewall 42. A seal 150 is carried by housing base 34 and axially engages a flange 152 on shaft 56. A pair of fluid pressure outlets 154, 156 project radially outwardly from sidewall 42 for feeding fluid under pressure to external devices, such as an aircraft engine fuel control system.

Figure 2:
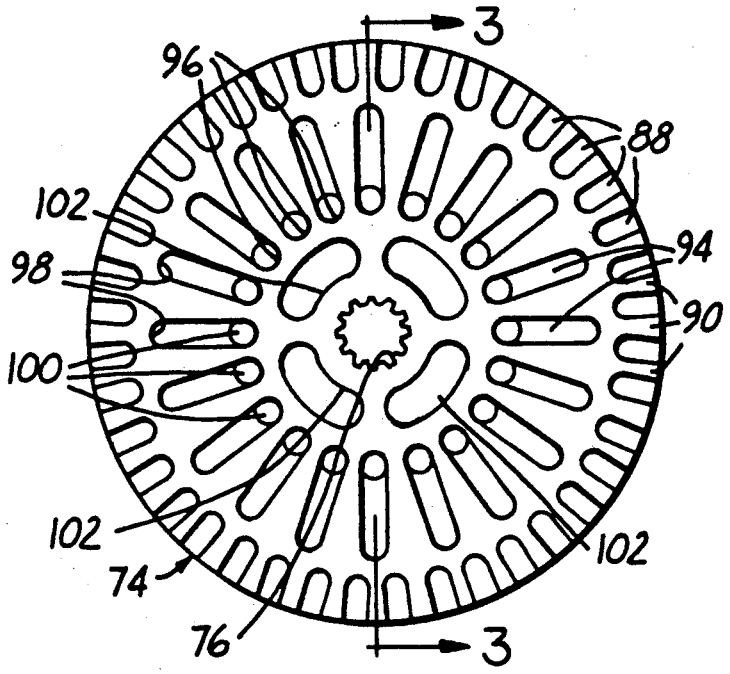
FIG. 2 is an axial elevational view of the impeller in the pump of FIG. 1.

An impeller 74 has an internally splined central opening 76 (FIGS. 1-3) that is rotatably coupled to a corresponding section 78 of shaft 56 between lands 58, 60. The disc-shaped body of impeller 74 has axially opposed flat side faces 80, 82 in sliding contact with opposed flat inner faces 84, 86 of backup plates 50, 46 respectively. A circumferential array of uniformly spaced depressions or buckets 88 extend around the periphery of impeller 74 at the outer edge of each side face 80, 82, with the impeller periphery between adjacent buckets 88 forming a multiplicity of radially extending vanes 90 interconnected by a central web 92. A plurality of radially extending slots or channels 94 are formed in a uniformly spaced circumferential array around each impeller side face 80, 82. Each channel 94 has a closed arcuate inner radial end 96 and a closed arcuate outer radial end 98, the inner and outer ends of all channels 94 on both impeller side faces being axially aligned with each other and concentric with the central axis of impeller 74. Circumferentially of impeller 74, channels 94 are positioned between alternating pairs of peripheral depressions 88, as best seen in FIG. 2. The bases of channels 94 within the rotor body are of arcuate concave construction. Inner ends 96 of axially opposing channels 94 are interconnected by a cylindrical passage 100 that extends through the impeller body. Radially inwardly of the arrays of channels 94, four arcuate kidney-shaped passages 102 extend axially through impeller 74. Passages 102 are circumferentially spaced uniformly with respect to each other approximately midway between splined central opening 76 and inner ends 96 of channels 94.

Figure 13:
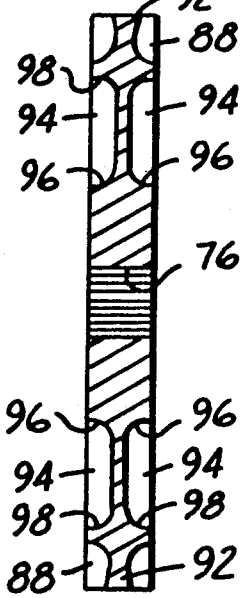
FIG. 13 is a sectional view similar to that of FIG. 3 but showing the impeller of FIG. 12 in greater detail.
Figure 12:
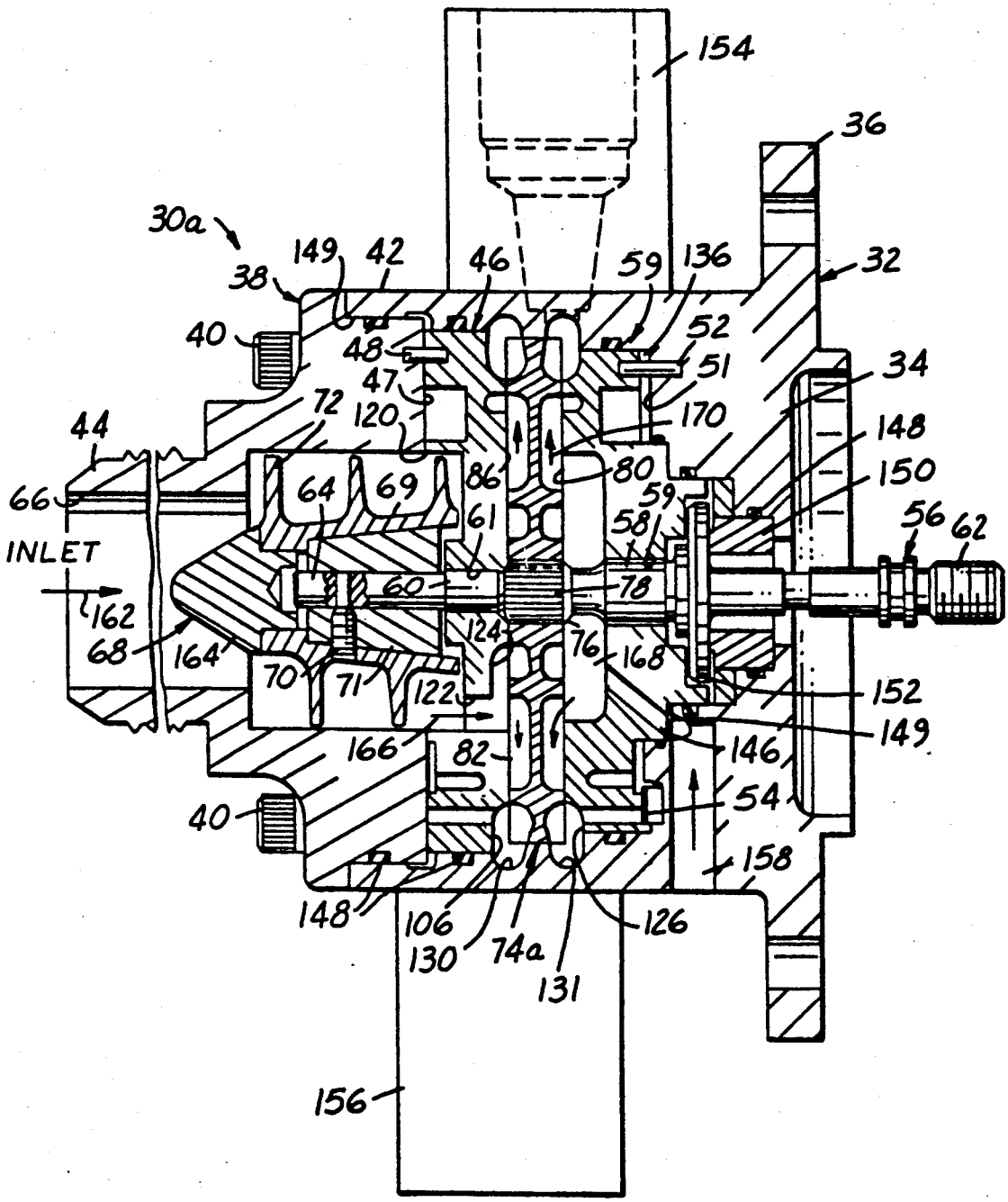
FIG. 12 is a diametrially sectioned side elevational view of a modification to the pump of FIG. 1.

FIGS. 12 and 13 illustrate a modified pump 30*a* configured for "high point scavenging". One side of impeller 74*a* is connected to the inducer discharge. The other side is connected to a secondary inlet port 158. In passages 100, 102 in impeller 74 (FIGS. 1-3) are deleted from impeller 74*a*.

Figure 7:
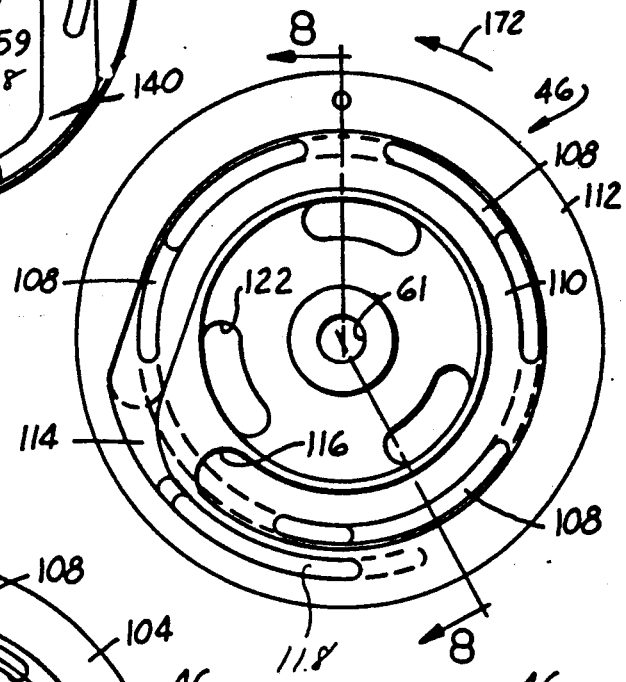
FIG. 7 is an end elevational view of the impeller-remote or outer face of the rear backup plate in the pump of FIG. 1.
Figure 9:
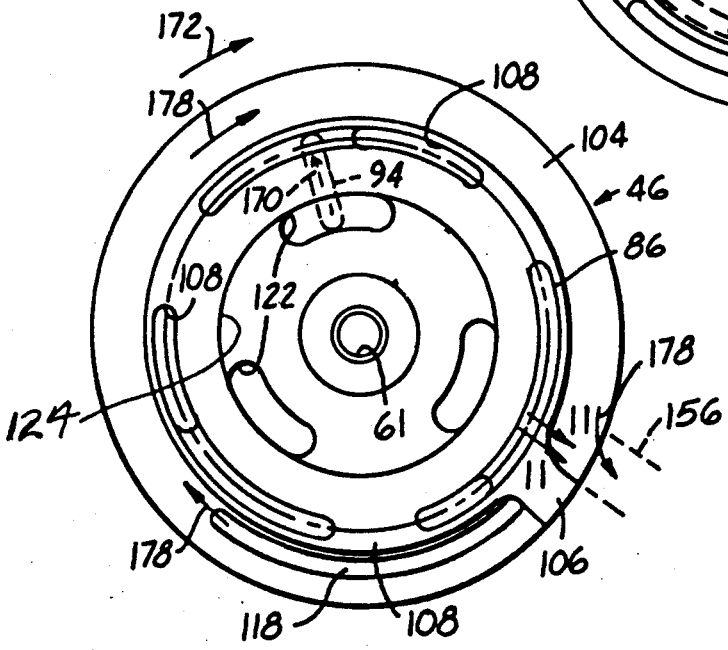
FIG. 9 is an end elevational view of the impeller-adjacent or inner face of the rear backup plate in the pump of FIG. 1.
Figure 8:
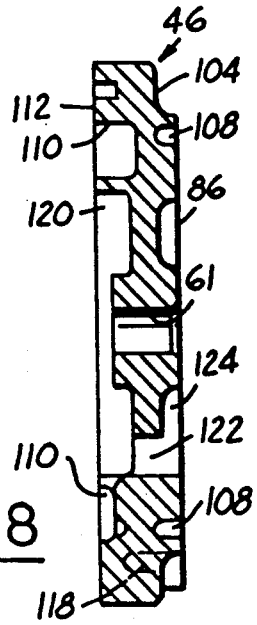
FIG. 8 is a sectional view taken substantially along the line 8—8 in FIG. 7.
Figure 11:
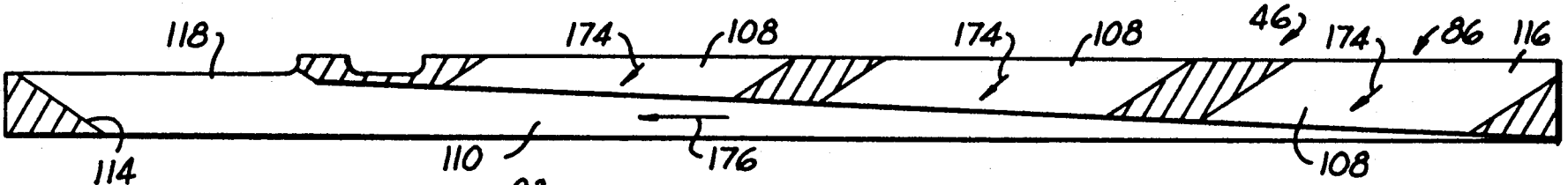

Rear backup plate 46 is illustrated in greater detail in FIGS. 7-8 and 11 as comprising a generally disc-shaped body with a concave channel 104 extending around the periphery at the inner or rotor-adjacent plate face 86. Channel 104 is interrupted by a ledge 106 (FIG. 9).

Three angularly spaced arcuate kidney-shaped passages 108 are distributed around inner face 86 radially inwardly of channel 104 and on a common center coaxial with backup plate center opening 61. As best seen in FIG. 1, passages 108 register in assembly with outer ends 98 of impeller channels 94. Passages 108 extend through backup plate 46 at an angle to the axis, as best seen in FIG. 11, and open onto a channel 110 at the outer or impeller-remote face 112 of backup plate 46. Channel 110 extends entirely around the flat outer face 112 of backup plate 46 generally concentricly with the backup plate axis for a major portion of its circumferential dimension. As best seen in FIG. 7, channel 110 is of generally uniform radial dimension, but terminates in an end portion 114 of reduced radial dimension that radially outwardly overlaps the inner end 116 of channel 110. Channel 110 is of increasing depth from end 116 toward end 114, at the latter of which a passage 118 extends through the backup plate into peripheral channel 104. Passages 108 extend into that portion of channel 110 of generally uniform radial dimension, as best seen in FIG. 7, and are angulated toward end 114, as best seen in FIG. 11.

Radially inwardly of channel 110, a generally cup-shaped pocket 120 is formed in backup plate outer face 112 coaxially surrounding center opening 61. As shown in FIG. 1, the inner or inlet-remote edge of inducer skirt 69 is positioned in assembly within pocket 120. Three angularly spaced arcuate kidney-shaped passages 122 extend through backup plate 46 from pocket 120 at the outer periphery thereof to plate inner face 86. As best seen in FIG. 1, kidney-shaped passages 122 radially register in assembly with passages 100 in impeller 74, and pocket 124 effectively couples passages 122 to kidney-shape passages 102 in impeller 74 during impeller rotation in which passages 102 and pocket 124 are in axial registry.

Figure 10:
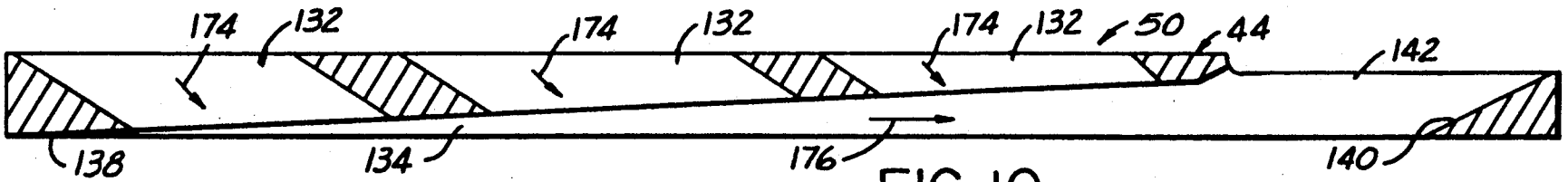
FIGS. 10-11 are developed sectional views taken substantially along the lines 10—10 and 11—11 in FIGS. 4 and 9 respectively.

Front backup plate 50 (FIGS. 1, 4–6 and 10) comprises a generally disc-shaped body having an arcuate concave channel 126 that extends around the periphery of inner backup plate surface 84. A ledge 128 (FIG. 4) interrupts channel 126 and aligns in assembly with ledge 106 (FIG. 9) of backup plate 46. Peripheral channels 104, 126 in backup plates 46, 50 respectively cooperate with a pair of radially inwardly facing annular channels 130, 131 (FIG. 1) in shell sidewall 42 to form an arcuate fluid pumping chamber that extends around the periphery of impeller 74. Ledges 106, 128 separate the angularly spaced inlet and outlet ends of the periphery pumping chamber, as will be described. Three arcuate through-passages 132 are uniformly distributed around the backup plate axis concentrically therewith and radially inwardly adjacent to peripheral channel 126. Passages 132 extend at an angle with respect to the backup plate axis, as best seen in FIG. 10, from inner face 44 to a channel 134 on the outer face 136 of backup plate 50. Passages 132 in plate 50 are identical to passages 108 in plate 46. Channel 134 is essentially the mirror image of channel 110 in backup plate 46 (FIGS. 7–8), having an inner end 138 (FIG. 6) axially aligned with channel end 116 in backup plate 46, and an outer end 140 that terminates in a passage 142 extending at an angle through backup plate 46 to peripheral channel 126 adjacent to ledge 128. Passages 132, which are essentially the mirror images of passages 108 in backup plate 46 (FIGS. 7–9), are angulated toward channel end 140.

On inner face 84 of backup plate 50, pocket 144 surrounds central opening 59, with the outer edges 145 being at a radius to register with impeller passages 100 (see FIG. 1) and at an angle to align in assembly with the passages 122 in backup plate 46. Three kidney-shaped passages 146 extend through backup plate 50 at an angle to the axis from pocket 144 on inner face 84 to a ledge 147 on outer face 136. An annular cavity 149 (FIG. 1) is formed between ledge 147 and the opposing surface 57 of housing base 34. Cavity 149 opens to a radial passage 158 (FIG. 1) in housing sidewall 42, which is connected in assembly to the high point of the inlet line. This provides for "high point scavenging" when used (FIGS. 12–13), or may be plugged during normal operation. When port 158 is used for high point scavenging, the impeller is of configuration **74*a* illustrated in FIGS. 12 and 13**.

In operation inlet fuel is fed in the direction 162 (FIG. 1) axially into collar 44 toward nose 164 of impeller 68. Rotation of inducer 68 by drive shaft 56 draws inlet fluid, thereby reducing pressure at the inlet and promoting fluid flow. Fluid (and any accompanying vapor) is compressed by the auger-like action of spiral vane 72, in cooperation with conical skirt 69 and the surrounding cylindrical cavity, and propells fluid at boosted pressure in the direction 166 (FIG. 1) through passages 122 to pockets 124 on interface 86 of backup plate 46. Inlet fluid from inducer 68 is also fed in the directions 170 into impeller channels 94 as the channel inner ends register with the cup area in plates 46 and 50. Centrifugal force of impeller rotation urges the fluid in impeller channels 94 radially outwardly in the direction 170 into slots 108, 132 in backup plates 46, 50. It will be noted in FIGS. 4 and 9, in which a slot 94 has been superimposed in phantom for purposes of illustration, that slots 94 directly couple pockets 124, 144 to passages 108, 132 during rotation of impeller 74 in the direction 172. The outer ends of slots 94 are covered by the respective faces of backup plates 84, 86 during portions of rotation of impeller 74. This configuration has the advantage of interrupting the outward flow to slots 110, 136 to effect bubbles suppression by the starting and stopping of the fluid transfer in passages 94. The configuration also serves to reduce the size of the bubbles allowed to pass through the system into the inlet of the peripheral pump forming the second stage of the pump system.

Figure 4:
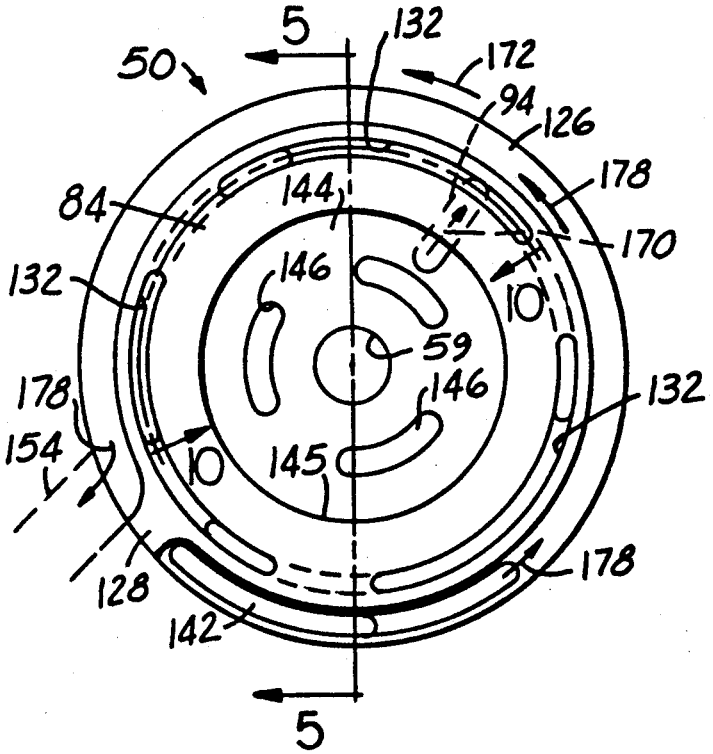
FIG. 4 is an end elevational view of the impeller-adjacent or inner face of the front backup plate in the pump of FIG. 1.
Figure 5:
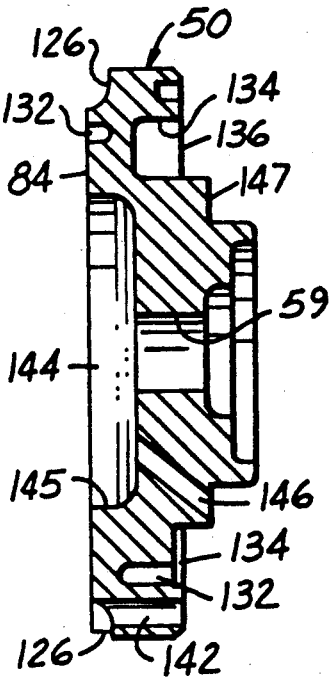
FIG. 5 is a section view taken substantially along the line 5—5 in FIG. 4.
Figure 6:
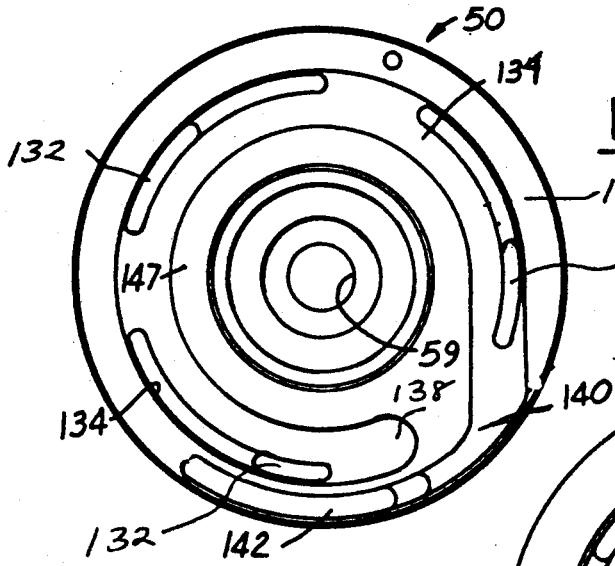
FIG. 6 is an end elevational view of the impeller-remote or outer face of the front backup plate in the pump of FIG. 1.

Fluid flowing outwardly in the directions 174 (FIGS. 10 and 11) through passages 108, 132 enters channels 110, 134 on the outer faces of backup plates 46, 50, and thence flows in the directions 176 around the backup plates and through passages 118, 142 to the inlet end of the periphery pumping chamber. Fluid is then pumped in the directions 178 (FIGS. 4 and 9), by rotation of impeller 74 in the direction 172, to pump outlets 154, 156 (FIG. 1, phantom in FIGS. 4 and 9). As previously noted, channels 110, 134 on the outer faces of backup plates 46, 50 are of increasing depth in the direction of the respective outlet openings 118, 142—i.e., in the direction of impeller rotation and fluid flow. Thus, channel size effectively increases as more fluid is pumped into the channels through passages 108, 136. This structure has the advantage of providing fluid flow passages proportional to the amount of fluid flowing in that particular segment of the pump design. It will also be noted that passages 108, 136 are angled in the direction of fluid flow so as to assist fluid flow in the directions 176 in channels 110, 134.

Figure 14:
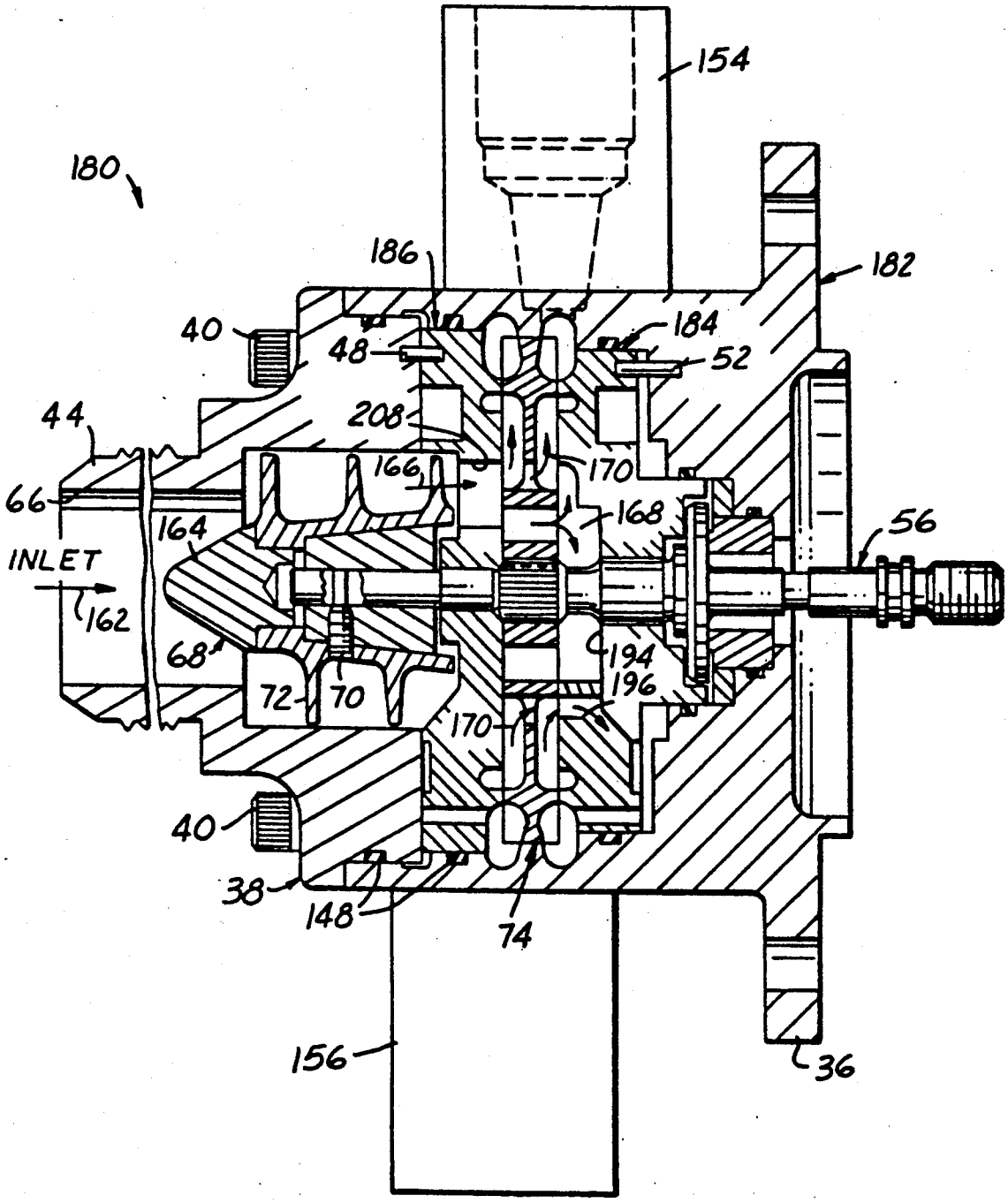
FIG. 14 is a diametrically sectioned side elevational view of a periphery pump in accordance a second embodiment of the invention.

FIGS. 14–24 illustrate a periphery pump 180 in accordance with a second embodiment of the invention. Pump 180 is similar in many respects to pump 30 hereinabove described in detail. Inlet cover 38, inducer 68, drive shaft 56 and impeller 74 in pump 180 are identical to those hereinabove described. Housing 182 of pump 180 is essentially identical to housing 32 of pump 30, with the exception that passage 158 in housing 32 (FIG. 1) is not included in housing 182 (FIG. 14). The primary difference between pump 180 and pump 30 lies in the configurations and orientations of the fluid channels and passages in the front and rear backup plates 184, 186 (FIG. 14) and fluid flow therethrough, and only these differences will be discussed in detail. (Passage 158 may also be employed as illustrated in FIG. 12 with the configurations and orientations for providing "high point scavenging.")

Figure 15:
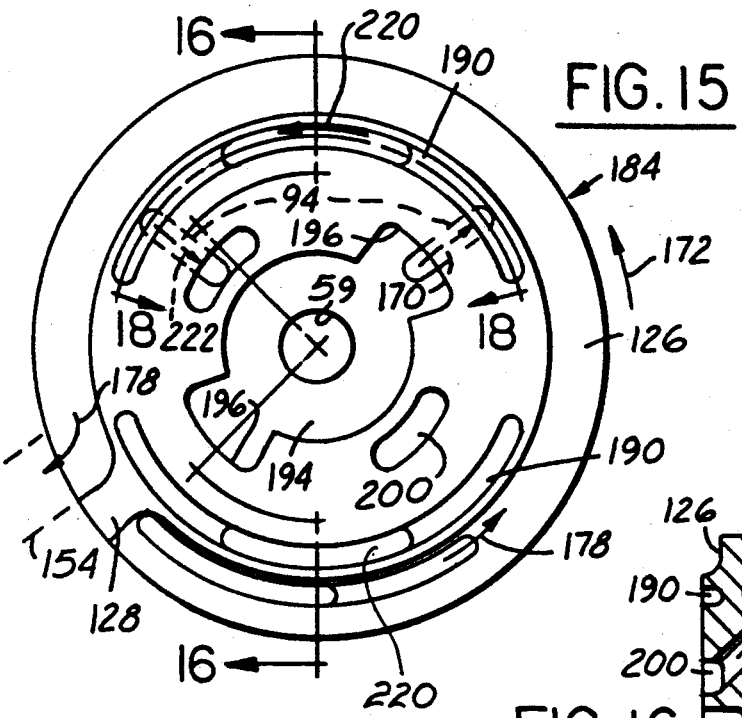
FIG. 15 is an end elevational view of the impeller-adjacent or inner face of the front backup plate in the pump of FIG. 14.
Figure 16:
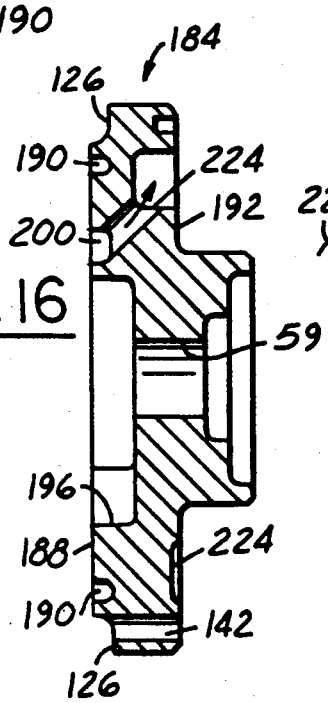
FIG. 16 is a sectional view taken substantially along the line 16—16 in FIG. 15.
Figure 18:
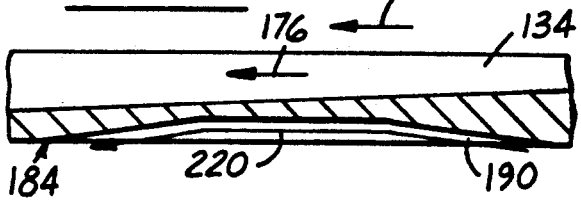
FIGS. 18 and 19 are developed sectional views taken substantially along the lines 18—18 and 19—19 in FIGS. 15 and 17 respectively.
Figure 17:
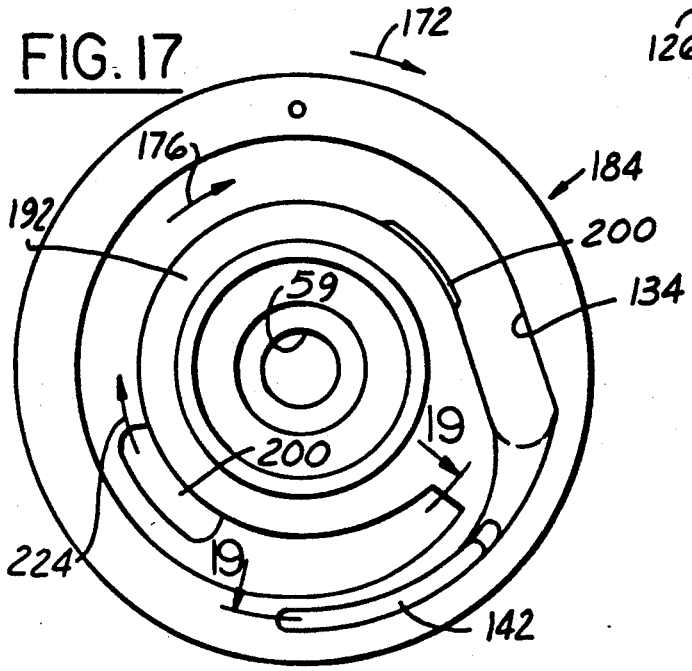
FIG. 17 is an end elevational view of the impeller-remote or outer face of the front backup plate in the pump of FIG. 14.
Figure 19:
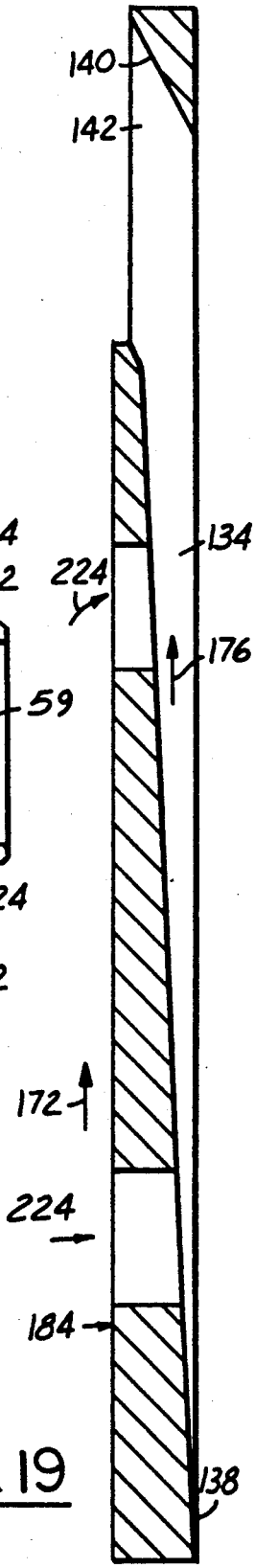
Figure 20:
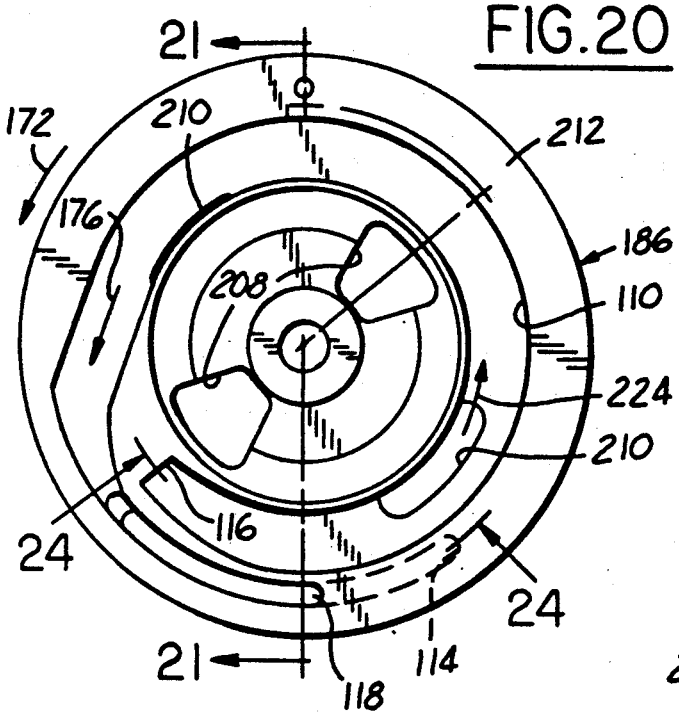
FIG. 20 is an end elevational view of the impeller-remote or outer face of the rear backup plate in the pump of FIG. 14.
Figure 21:
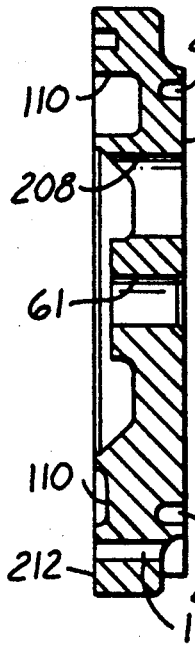
FIG. 21 is a sectional view taken substantially along the line 21—21 in FIG. 20.

Front backup plate 184 is illustrated in detail in FIGS. 15–19, and comprises a generally disc-shaped body having peripheral channel 126 formed around the inner or impeller-adjacent face 188 and interrupted by input-/output separation ledge 128. A pair of diametrically opposed arcuate slots or channels 190 extend part-way around inner face 188 radially inwardly adjacent to channel 126. As best seen in the fragmentary cross section of FIG. 18, the axial dimension or depth of channels 190 initially increases with angle, then remains constant, and then decreases circumferentially of the backup plate axis, while remaining of uniform radial dimension (FIGS. 15–16). Channels 190 do not open to the outer face 192 of backup plate 184. A pocket 194 surrounds center opening 59 on inner face 188 and has a pair of projections 196 that extend diametrically oppositely of pocket 194 to positions that register with the inner ends 96 of impeller slots 94. Pocket projections 196 generally diametrically align with the leading edges of channels 190 with respect to the direction 172 of impeller rotation.

A pair of kidney-shaped passages 200 are diametrically opposed to each other on backup plate face 188 at a radial position to register with inner impeller channels ends 96 and in radial alignment with the trailing edges of channels 190, again with reference to the direction 172 of impeller rotation. Passages 200 (FIG. 16) extend axially and radially outwardly through the body of backup plate 184 to channel 134 on outer face 192 of plate 184. Channel 134 has been described in detail in connection with backup plate 46 of pump 30.

Rear backup plate 186 is illustrated in detail in FIGS. 20–24. Peripheral channel 104 and input/output separation ledges 106 are the mirror images of channel 126 and separation ledge 128 on front backup plate 184. Likewise, arcuate channels 204 on the inner face 206 of backup plate 186 are the mirror images of channels 190 on backup plate 184. A pair of generally triangular through-passages 208 are opposed in assembly (FIG. 14) to pocket projections 196 on backup plate 184, and a pair of kidney-shaped through-passages 210 are the mirror images of and opposed in assembly to passages 200 in backup plate 184. Passages 210 communicate with channel 110 that extends around the outer surface 212 of backup plate 186, with channel 110 having been described in detail hereinabove. Channel 110 terminates in passage 118 at the inlet end of the pumping chamber adjacent to inlet/outlet separation ledge 106.

Figure 22:
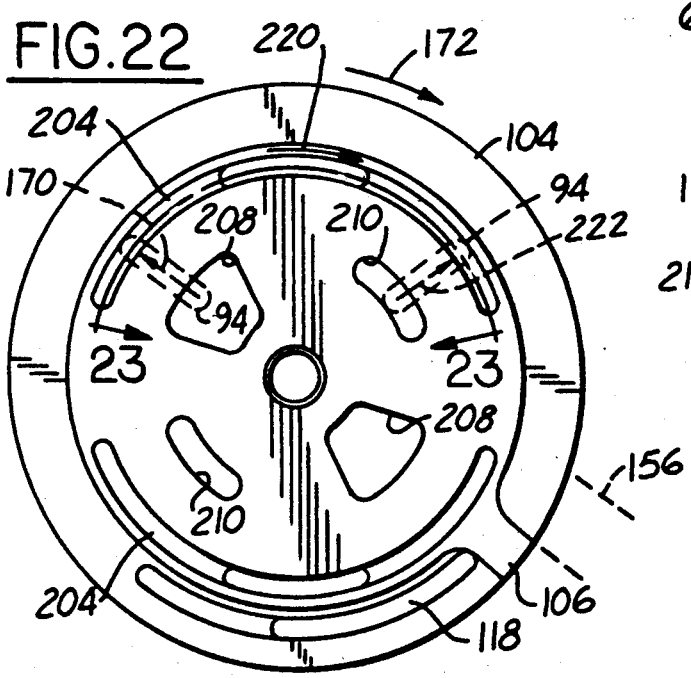
FIG. 22 is an end elevational view of the impeller-adjacent or inner face of the rear backup plate in the pump of FIG. 14.
Figure 23:
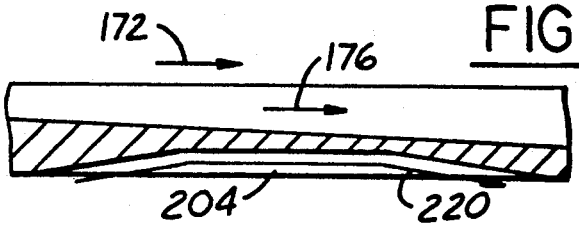
FIGS. 23 and 24 are developed sectional views taken substantially along the lines 23—23 and 24—24 in FIGS. 22 and 20 respectively.
Figure 24:
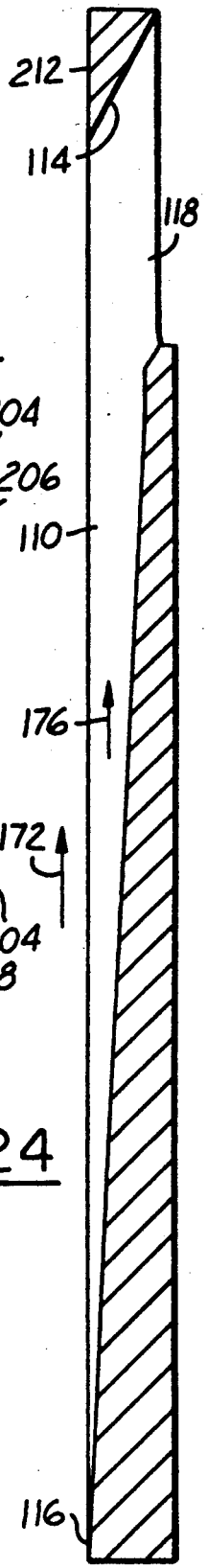

Thus, in pump 180, inlet fluid following in directions 162, 166 to and through inducer 68 (FIG. 14), then flows in the directions 170 in those impeller channels 94 that register with passages 208 in plate 186 and pocket 194 in plate 184 (see FIGS. 15 and 22). Such fluid is driven by the centrifugal force imparted thereto into channels 190, 204 on backup plates 184, 186, flows in the circumferential directions 220 (FIGS. 15, 18, 22 and 24), and then flows radially inwardly in the directions 222 (FIGS. 15 and 22) in the impeller slots that register with the trailing ends of channels 190, 204 and passages 200, 210. The contour of channels 190, 204 hereinabove described cooperates with the opposing impeller channels to obtain fluid pressure boost through a liquid piston action by having the fluid, in the form of a "liquid piston" in channels 98 of impeller 74, cause fluid to exit into channels 190, 204 by centrifugal action. The movement of fluid radially outwardly acts as piston to pull additional fluid in through ports 196, 208. The ports are closed by the space between passages 208, 210, and projection 196 and passage 200, to trap the column of fluid in channel 98 of impeller 74. With subsequent rotation, the column of fluid is force to exit through ports 200, 210 by the rise in cavity 180. This enables the fluid to be pressurized by the action of port 190 on the upper end of the column of fluid in impeller channel 98.

Fluid entering passages 200, 210 in backup plates 184, 186 flows in the directions 224 (FIGS. 16–17 and 20) into channels 110, 134 on the outer faces of the respected backup plates, and thence in the directions 176 in channels 110, 134 to the periphery pumping cavity. Thus, pump 180 of FIGS. 14–24 has the advantage over pump 30 of being able to pump "vapor" as well as liquid by the use of a "liquid piston" suitably controlled in motion and porting. This device is particularly useful in pulling vapor off of high points in inlet lines, thereby reducing the vapor level at the inlet to the fuel pump. It also is an effective scavenge pump because a "piston" is formed of "zero" tolerance to its respective bore (channel 98 in impeller 74), and thus is able to operate at low pressures quite effectively when fluid viscosity is low, such as encountered in fuel systems. The length and depth of channels 190 and 204 can be tailored to the needs of the system by the length/rate of depth increase of the groove, the length/arc of the uniform depth area where in-hold time to collapse the fluid bubbles is important, and by the length/rate of the decrease in depth of the groove.

A second feature is the ability of the "liquid piston" to prime the system if the pump runs out of fluid since fluid is trapped in the impeller. With the trapped fluid, the system is able to restart using the residual fluid. A further advantage of this concept is the simplification of the well known "Nash liquid piston" principle, while offering better sealing characteristics for the fluid being pumped. This design will have better low inlet pressure characteristics than pump 30 by the use of the "piston" effect. The design can also be configured to be a one, two, three or four lobe design depending upon application requirements.

An advantage of pump 30 over pump 180 is the capacity of the first stage to supply fluid to the regenertive/peripheral impeller. All of the passages 98 in impeller 74 are used continuously, except for the interruptions to upset any bubbles that may have been trapped in the fluid column. Pump 30 also has the ability to be oversized to handle a specific vapor/liquid ratio by the design of the passages 98. Pump 30 will also generate higher pressure from the first stage than pump 180 because the fluid direction is not reversed. However, the inlet characteristics for pump 30 will not be as good as those of pump 180.

It should also be recognized that the lengths of passages 98 in impeller 74 may be changed to fit the needs of the system into which the pump is fitted. Longer passages giving additional hold time and additional pressure rise dependent on design characteristics. The base diameter and outside diameters are also tailored to the application requirements.

I claim:

1. A hydraulic periphery pump that includes a housing, a drive shaft mounted for rotation about its axis within said housing, an impeller coupled to said shaft for rotation within said housing and having a disc-shaped body with at least one axially oriented substantially flat side face and a circumferential array of peripheral vanes, backup means in said housing having a flat face opposed to said impeller side face, means in said housing forming an arcuate fluid chamber around said impeller with angularly spaced chamber fluid inlet and outlet means, and means for feeding fluid to said inlet means; characterized in that said fluid-feeding means comprises:

at least one radially oriented channel in said impeller side face having closed radially inner and outer ends, first means including an inlet passage positioned in said backup means to register with said inner end of said channel during rotation of said impeller for feeding inlet fluid to said radially inner end of said channel during one arcuate portion of rotation of said impeller, and second means including arcuate outlet means positioned in said backup means at a greater radius from said axis than said inlet passage to register with said outer end of said channel during a second arcuate portion of rotation of said impeller for feeding fluid from said radially outer end of said impeller channel to said chamber during said second arcuate portion of rotation of said impeller.

2. The pump set forth in claim 1 wherein said inlet passage and said arcuate outlet means at least partially radially overlap circumferentially of said axis.

3. The pump set forth in claim 2 wherein said backup means comprises a backup plate having a flat inner face opposed to said impeller and an outer face opposed to said housing, said second means further comprising an arcuate channel in at least one of said inner and outer faces interconnecting said arcuate outlet means and said chamber.

4. The pump set forth in claim 3 wherein said fluid-feeding means comprises a plurality of said radially oriented channels disposed in a uniformly spaced circumferential array around said impeller side face, said inner and outer ends of said plurality of channels being concentric with said axis.

5. The pump set forth in claim 4 wherein said impeller body has axially opposed substantially flat side faces, wherein said backup means comprises backup plates having flat faces opposed to said impeller side faces, there being circumferential arrays of radially oriented channels in both side faces of said impeller, and arcuate outlet means and arcuate channels in both of said backup plates.

6. The pump set forth in claim 3 wherein said arcuate channel is of non-uniform cross section circumferentially lengthwise of said channel.

7. The pump set forth in claim 6 wherein said cross section increases substantially uniformly with arcuate length of said arcuate channel between said arcuate outlet means and said chamber.

8. The pump set forth in claim 7 wherein said second channel is disposed in said outer face of said backup means and is connected with said arcuate outlet means and said chamber by passages extending through said backup means.

9. The pump set forth in claim 7 wherein said arcuate outlet means includes a second channel disposed in said inner face of said backup means.

10. The pump set forth in claim 9 wherein said second channel has closed circumferentially spaced ends and is positioned to register with radially outer ends of said impeller channels, and wherein said arcuate outlet means further comprises arcuate passage means positioned to register with inner ends of said impeller channels during said second portions of rotation and opening into a second on said outer face.

11. A hydraulic periphery pump that includes a housing having a drive shaft mounted for rotation about its axis therewithin, an impeller coupled to said shaft for rotation within said housing and having a disc-shaped body with axially opposed substantially flat side faces and a circumferential array of peripheral vanes, a pair of backup plates in said housing each having a flat inner face opposed to a flat side face of said rotor and an outer face opposed to said housing, an arcuate fluid chamber between said backup plates and said housing around said periphery and having angularly spaced chamber fluid inlet and outlet means, and inlet means for feeding inlet fluid to said chamber inlet means; characterized in that said inlet fluid-feeding means comprises:

a plurality of radially extending channels disposed in a uniformly spaced circumferential array on each said impeller side face and having closed radially inner and outer ends concentric with said axis, first means including first ports in said backup plates for feeding inlet fluid to said radially inner ends of said channels during first arcuate portions of rotation of said impeller, second means in said backup plates including second ports for receiving fluid from said outer ends of said channels during second arcuate portions of rotation of said impeller, arcuate channels in one of said inner and outer faces of said backup plates and passages in said backup plates from said second ports to said arcuate channels and from said arcuate channels to said chamber.

12. The pump set forth in claim 11 wherein said arcuate channels increase in cross section between said second ports and said chambers.

13. The pump set forth in claim 12 wherein said first and second ports comprise kidney-shaped slots positioned in circumferential arrays in said backup plates for registry with multiple adjacent channel ends.

14. The pump set forth in claim 13 wherein kidney-shaped slots of said first and second ports radially overlap circumferentially of said axis.

15. The pump set forth in claim 11 wherein said inlet means comprises an open inlet collar coaxial with said shaft, and a spiral-vane inducer disposed in said collar and coupled to said shaft for boosting pressure of inlet fluid.

16. The pump set forth in claim 15 wherein said housing is of open cup-shaped contour, said impeller and backup plates being telescopically received in said housing, and wherein said collar is carried by an inlet cover mounted on an open edge of said housing coaxially with said shaft.

17. The pump set forth in claim 11 wherein said first means includes angularly spaced arcuate passages extending through a first of said backup plates for receiving fluid, pocket means on said inner face of said first backup plate for coupling said arcuate passages to said first ports in said first backup plate, arcuate passages in said impeller positioned radially inwardly of said radial channels and extending axially through said impeller body, and pocket means on said inner face the second of said backup plates for feeding fluid from said arcuate passages to said first ports in said second backup plate.

18. The pump set forth in claim 17 further comprising a passage extending through said second backup plate and through said housing, and means to pump fluid from a second inlet port to said pump.

* * * * *